US012454393B2

(12) United States Patent
Mai et al.

(10) Patent No.: US 12,454,393 B2
(45) Date of Patent: Oct. 28, 2025

(54) CLOSURE DEVICE FOR A CONTAINER

(71) Applicant: HUSKY INJECTION MOLDING SYSTEMS LTD., Bolton (CA)

(72) Inventors: Arnold Heinz Mai, Irrel (DE); Tobias Naumann, Merzig (DE)

(73) Assignee: Husky Injection Molding Systems Ltd., Bolton (CA)

( * ) Notice: Subject to any disclaimer, the term of this patent is extended or adjusted under 35 U.S.C. 154(b) by 644 days.

(21) Appl. No.: 17/905,519

(22) PCT Filed: Mar. 4, 2021

(86) PCT No.: PCT/CA2021/050284

§ 371 (c)(1),
(2) Date: Sep. 2, 2022

(87) PCT Pub. No.: WO2021/189127

PCT Pub. Date: Sep. 30, 2021

(65) Prior Publication Data

US 2023/0117474 A1 Apr. 20, 2023

Related U.S. Application Data

(60) Provisional application No. 62/993,898, filed on Mar. 24, 2020.

(51) Int. Cl.
*B65D 45/18* (2006.01)
*B65D 41/00* (2006.01)

(52) U.S. Cl.
CPC ..... *B65D 45/18* (2013.01); *B65D 41/005* (2013.01); *B65D 2251/20* (2013.01); *B65D 2401/30* (2020.05)

(58) Field of Classification Search
CPC ..... B65D 41/005; B65D 41/0457; B65D 41/0421; B65D 41/0428; B65D 41/0435;
(Continued)

(56) References Cited

U.S. PATENT DOCUMENTS 3,441,161 A * 4/1969 Van Baarn ..... B65D 41/0421 D9/446
5,275,287 A * 1/1994 Thompson ..... B65D 41/0421 215/354

(Continued)

FOREIGN PATENT DOCUMENTS

FR 1247480 A 12/1960
GB 812580 A * 4/1959 ..... B65D 41/485

(Continued)

OTHER PUBLICATIONS

Extended European Search Report dated Apr. 4, 2024 for European Application No. EP 21775342.5.

*Primary Examiner* — Robert J Hicks
(74) *Attorney, Agent, or Firm* — Wolf, Greenfield & Sacks, P.C.

(57) ABSTRACT

A closure device for a container neck having a cap which is pivotable between closed open configurations, comprising: a base; an outer wall extending circumferentially around the base; a plug seal extending from the base, at an inner face of the cap, and spaced from the outer wall to define a channel for receiving the container neck and for forming a seal against an inner wall of the container neck when the cap is in the closed configuration; a lifting member extending from the base and positioned radially inwardly from the plug seal, the lifting member being positioned at a pivot-side of the cap and having a contact face at a free end of the lifting member for contacting a top end of the container neck before the top end contacts the plug seal during actuation of the cap from the open configuration to the closed configuration.

54 Claims, 10 Drawing Sheets

(58) Field of Classification Search
CPC ..... B65D 41/0414; B65D 41/325; B65D 41/3447; B65D 45/18; B65D 45/16; B65D 47/0838; B65D 2401/30; B65D 2401/15; B65D 2251/20; B65D 2251/1058
USPC ..... 215/237, 235, 346, 344, 343, 341, 256, 215/254, 253, 250; 220/836, 810, 324, 220/315, 266, 265
See application file for complete search history.

(56) References Cited

U.S. PATENT DOCUMENTS

| | | | | |
|---|---|---|---|---|
| 5,785,193 | A | 7/1998 | Kobayashi et al. | |
| 6,116,477 | A | 9/2000 | Kreiseder et al. | |
| 6,170,683 | B1 | 1/2001 | Montgomery | |
| 7,651,004 | B2 * | 1/2010 | Fuchs | B65D 41/0421 215/DIG. 1 |
| 2014/0076840 | A1 | 3/2014 | Graux et al. | |
| 2022/0073238 | A1 * | 3/2022 | Naumann | B65D 55/16 |
| 2022/0227541 | A1 * | 7/2022 | Falzoni | B65D 41/485 |

FOREIGN PATENT DOCUMENTS

| | | | |
|---|---|---|---|
| GB | 1075949 | A | 7/1967 |
| GB | 1 417 152 | A | 12/1975 |
| WO | 2004094239 | A2 | 11/2004 |
| WO | 2019192714 | A1 | 10/2019 |

* cited by examiner

CLOSURE DEVICE FOR A CONTAINER

CROSS-REFERENCE TO RELATED APPLICATIONS

This application is a national stage filing under 35 U.S.C. § 371 of International Patent Application Ser. No. PCT/CA2021/050284, filed Mar. 4, 2021, which claims the benefit of priority under 35 U.S.C. § 119 (e) of U.S. application serial number Application Ser. No. 62/993,898, filed Mar. 24, 2020.

TECHNICAL FIELD

The present technology relates to a closure device for a container.

BACKGROUND

Containers, such as bottles, are generally provided with closure devices, such as caps, to fluidly seal the container. The ability to repeatedly open and re-close such containers is desirable for sealing contents of the container between multiple accesses. The re-closability of such containers is also a desirable feature in rendering the containers re-fillable and re-usable which has clear benefits for the environment, as well as economic and convenience advantages to the user.

However, in containers in which the cap remains tethered to a band and which rely on a plug seal in the cap for fluid sealing, re-closing can be problematic. FIGS. 1A and 1B illustrate a closure device 10 of the prior art comprising a cap 11 having an inner circumferential wall 12 ("plug seal 12") which together with an outer wall 13 of the cap 11 defines a channel 14 for sealingly receiving a container wall 15 of a container 16. Reclosing the cap 11 over the container 16, without a repositioning after opening, causes the plug seal 12 to impact an outer side 17 of the container wall 15. This can lead to deformation or breakage of the plug seal 12, resulting in an ineffective sealing and subsequent leaking of the container 16 contents.

Furthermore, any solution to this problem must also take into account an ease of molding of the closure device, such as by molding.

SUMMARY

Embodiments of the present technology have been developed based on inventors' appreciation of at least one shortcoming associated with the prior art approaches to closure devices which are re-closable.

For example, U.S. Pat. No. 6,116,477 to Courtesy Corporation describes a cap which is movable between an open position and a closed position by pivoting the cap about a hinge so that the cap covers a base with a plug engaged over a spout. The plug has formed along an outer circumferential edge thereof depending guide ribs with canted edges which engage against the spout when the cap is moved to the closed position over the base. The guide ribs direct the plug to properly engage the spout and thereby prevent damage to the spout.

However, this solution does not address reclosing of closure devices that include a plug seal.

Accordingly, in certain aspects and embodiments of the present disclosure, there is provided a closure device which can be re-closed whilst ameliorating or avoiding at least some of the noted problems with prior art closure devices.

From a broad aspect, there is provided a closure device having a cap with a plug seal, and a lifting member which is arranged to contact a container wall at an open end of the container, during closing, before contact of the container wall with the plug seal, in order to reposition the cap relative to the open end of the container. The lifting member is provided at a pivot side of the closure device. The repositioning of the cap comprises moving a pivot region of the cap upwardly along the container neck. This can result in a substantial alignment of a vertical axis of the container wall with a vertical axis of a channel adjacent the plug seal as the container wall is being received in the channel. This can avoid damage to the plug seal.

Accordingly, from one aspect, there is provided a closure device for a container neck, the closure device having a cap which is pivotable between a closed configuration and an open configuration relative to the container neck, the cap comprising: a base; an outer wall extending circumferentially around the base; a plug seal extending from the base, at an inner face of the cap, and spaced from the outer wall to define a channel for receiving the container neck and for forming a seal against an inner wall of the container neck when the cap is in the closed configuration; a lifting member extending from the base and positioned radially inwardly from the plug seal, the lifting member being positioned at a pivot-side of the cap and having a contact face at a free end of the lifting member for contacting a top end of the container neck before the top end contacts the plug seal during actuation of the cap from the open configuration to the closed configuration.

In certain embodiments, the plug seal is annular.

In certain embodiments, the lifting member and the plug seal have a one-piece construction. In other words, they are not separated from one another. A portion of the one-piece construction may be thinned. The thinned portion may extend downwardly from the base and stop short of the free end of the lifting member.

In certain embodiments, at least a portion of the lifting member is spaced from the plug seal. In other words, the lifting member and the plug seal are at least partially separated from one another. A free end portion of the lifting member may be spaced from the plug seal.

In certain embodiments, the closure device further comprises a plurality of lifting members extending from the base and positioned radially inwardly from the plug seal, the plurality of lifting members being circumferentially spaced from one another and proximate the pivot-side of the cap. The plurality of lifting members may comprise two lifting members, positioned one on either side of a tongue at the pivot-side of the cap. The closure device may further comprise a third lifting member positioned between the two lifting members.

In certain embodiments, the contact face has a first end proximate the plug seal and a second end positioned radially inwardly to the first end, wherein the second end is rounded.

In certain embodiments, the contact face has a first end proximate the plug seal and a second end positioned radially inwardly to the first end, wherein the second end extends further from the base than the first end. A profile of the contact face may be one of: cambered, straight and undulating, or a combination thereof.

In certain embodiments, the contact face has a first end proximate the plug seal and a second end positioned radially inwardly to the first end, wherein the first and second ends extend by substantially the same distance from the base. A profile of the contact face may be one of: cambered, straight and undulating, or a combination thereof.

In certain embodiments, a length of the contact face is substantially longer than a thickness of the plug seal.

In certain embodiments, the pivot side of the closure device comprises a pivot point defined by one or more of: a hinge, a leash, a tongue, and a lip.

In certain embodiments, the closure device further comprises a TE band and at least one leash connecting the cap to the TE band.

In certain embodiments, the closure device further comprises a retention mechanism for retaining the cap in the open configuration.

From another aspect, there is provided a mold for forming a closure device by injection molding, the mold comprising a female cavity piece and a male core piece, the female cavity piece and the male core piece defining a molding cavity configured to form the closure device described herein.

From a yet further aspect, there is provided a closure device for a container neck, the closure device having a cap which is actuatable between a closed configuration and an open configuration relative to the container neck, the cap comprising: a base; an outer wall extending circumferentially around the base; a plug seal extending from the base, at an inner face of the cap, and spaced from the outer wall to define a channel for receiving the container neck and for forming a seal against an inner wall of the container neck when the cap is in the closed configuration; a lifting member extending from the base and positioned radially inwardly from the plug seal, the lifting member having a contact face at a free end of the lifting member for contacting a top end of the container neck during actuation of the cap from the open configuration to the closed configuration, wherein the lifting member is partially connected to the plug seal.

In certain embodiments, the lifting member is connected to the plug seal only at a free end portion thereof.

In certain embodiments, the lifting member is connected to the plug seal by a thinned portion. The thinned portion may extend downwardly from the base and stop short of the free end of the lifting member.

In certain embodiments, the lifting member is positioned at a pivot-side of the closure device and is adapted such that the contact face contacts a top end of the container neck before the top end contacts the plug seal during actuation of the cap from the open configuration to the closed configuration. The plug seal may be annular.

In certain embodiments, the closure device further comprises a plurality of lifting members extending from the base and positioned radially inwardly from the plug seal, the plurality of lifting members being circumferentially spaced from one another. The plurality of lifting members may comprise two lifting members, positioned one on either side of a tongue extending from an outer side of the cap. The closure device may further comprise a third lifting member positioned between the two lifting members.

In certain embodiments, the contact face has a first end proximate the plug seal and a second end positioned radially inwardly to the first end, wherein the second end is rounded.

In certain embodiments, the contact face has a first end proximate the plug seal and a second end positioned radially inwardly to the first end, wherein the second end extends further from the base than the first end. A profile of the contact face may be one of: cambered, straight and undulating.

In certain embodiments, the contact face has a first end proximate the plug seal and a second end positioned radially inwardly to the first end, wherein the first and second ends extend by substantially the same distance from the base. A profile of the contact face may be one of: cambered, straight and undulating.

In certain embodiments, a length of the contact face is substantially longer than a thickness of the plug seal.

In certain embodiments, the pivot side of the closure device comprises a pivot point defined by one or more of: a hinge, a leash, a tongue, and a lip.

In certain embodiments, the closure device further comprises a TE band and at least one leash connecting the cap to the TE band.

In certain embodiments, the closure device further comprises a retention mechanism for retaining the cap in the open configuration.

From a yet further aspect there is provided a mold for forming a closure device by injection molding, the mold comprising a female cavity piece and a male core piece, the female cavity piece and the male core piece defining a molding cavity configured to form the closure device described herein.

These and other aspects and features of non-limiting embodiments will now become apparent to those skilled in the art upon review of the following description of specific non-limiting embodiments in conjunction with the accompanying drawings.

DETAILED DESCRIPTION OF THE DRAWINGS

The non-limiting embodiments will be more fully appreciated by reference to the accompanying drawings, in which.

The drawings are not necessarily to scale and may be illustrated by phantom lines, diagrammatic representations and fragmentary views. In certain instances, details that are not necessary for an understanding of the embodiments or that render other details difficult to perceive may have been omitted.

DETAILED DESCRIPTION OF THE NON-LIMITING EMBODIMENT(S)

Reference will now be made in detail to various non-limiting embodiment(s) of a closure device for a container. It should be understood that other non-limiting embodiment (s), modifications and equivalents will be evident to one of ordinary skill in the art in view of the non-limiting embodiment(s) disclosed herein and that these variants should be within scope of the appended claims.

Furthermore, it will be recognized by one of ordinary skill in the art that certain structural and operational details of the non-limiting embodiment(s) discussed hereafter may be modified or omitted (i.e. non-essential) altogether. In other instances, well known methods, procedures, and components have not been described in detail.

Referring initially to FIGS. 2-5, according to non-limiting embodiments of the present technology, there is provided a closure device 20 for a container 22. The container 22 with which the closure device 20 is useable is not limited in its use, configuration or material. In the embodiments illustrated herein, the container 22 is a bottle, such as a drink bottle made of polyethylene terephthalate (PET). For example, the container 22 can be a blow-molded bottle for containing still water beverage or another flat beverage. Alternatively, the container 22 can be for a carbonated beverage. In yet further embodiments, the container 22 can be for a hot fill type of beverage (such as a drinkable yogurt, a fruit juice, or the like). However, the closure device 20 can be used with other types of containers.

Figure 2:
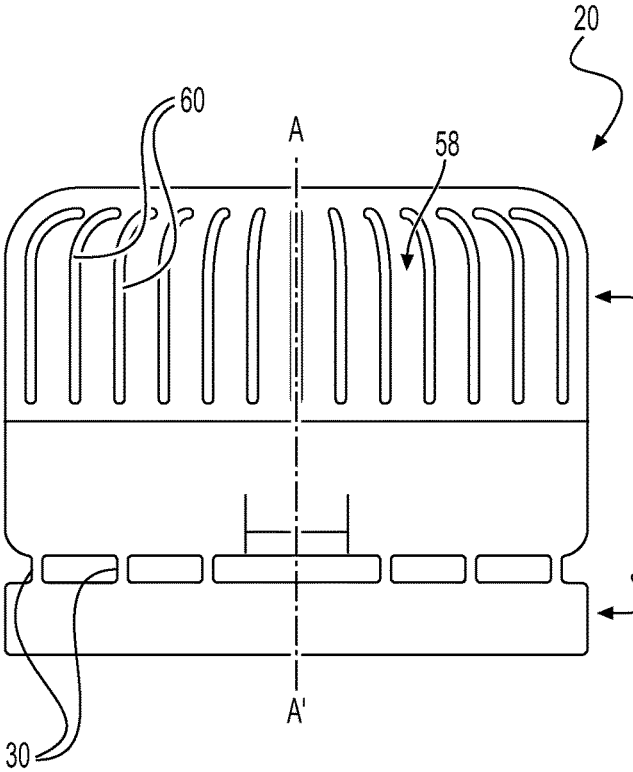
FIG. 2 is a side view of a closure device in a closed configuration, in accordance with some embodiments of the present technology.
Figure 3:
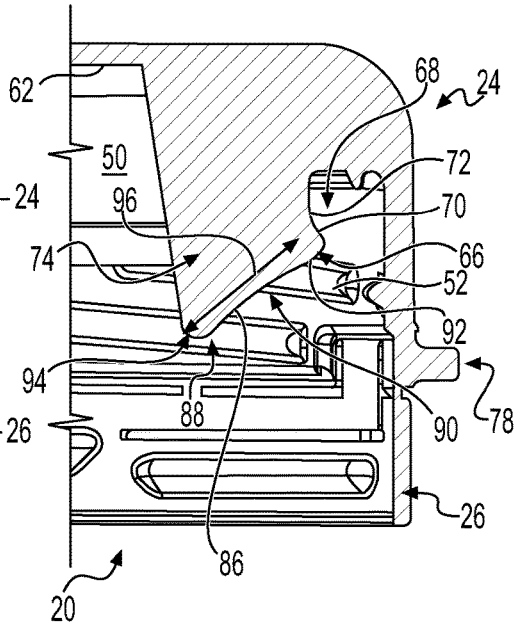
FIG. 3 is a sectional view of the closure device of FIG. 2, taken through the line A-A', in accordance with some embodiments of the present technology.
Figure 4:
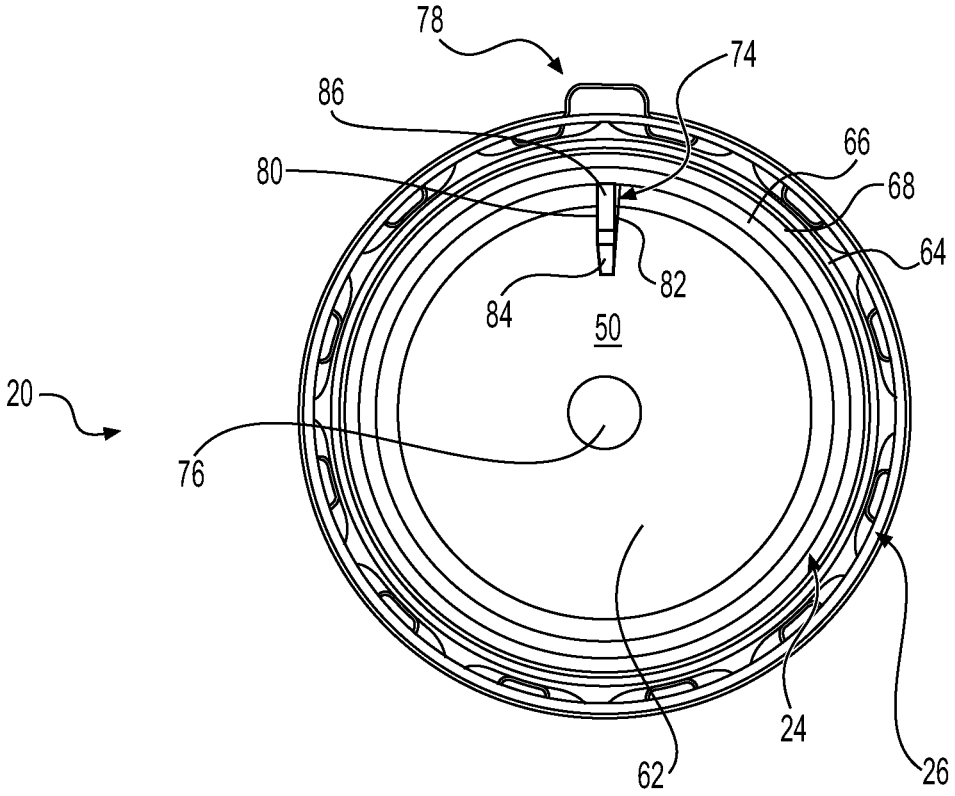
FIG. 4 is a plan view of the closure device of FIG. 2, in accordance with some embodiments of the present technology.

The closure device 20 comprises a cap 24. In certain non-limiting embodiments, the cap 24 is attached to a tamper evidence band (TE band) 26, such as by a leash 28 (seen in FIGS. 5A-5C), and moveable between an open configuration (FIG. 5A) and a closed configuration (FIGS. 2-4). The cap 24 is configured to be openable (actuated between the closed configuration to the open configuration), and to be re-closable (actuated between the open configuration to the closed configuration).

The closed configuration has a locked mode (FIG. 2) in which the cap 24 is connected to the TE band by frangible bridges 30, and an unlocked mode in which the frangible bridges 30 are broken yet the cap 24 remains closed on the container 22. This partial separation of the TE band 26 and the cap 24 allows for a "tamper indication"—i.e. an indication that the container 22 has been opened. The bridges 30 are arranged to be severed when the cap 24 and the TE band 26 are rotatably moved relative to one another. A tensile strength of the bridges 30 are lower than a tensile strength of the TE band 26, which means that the bridges 30 will be severed before tensile damage to the TE band 26.

Figure 8:
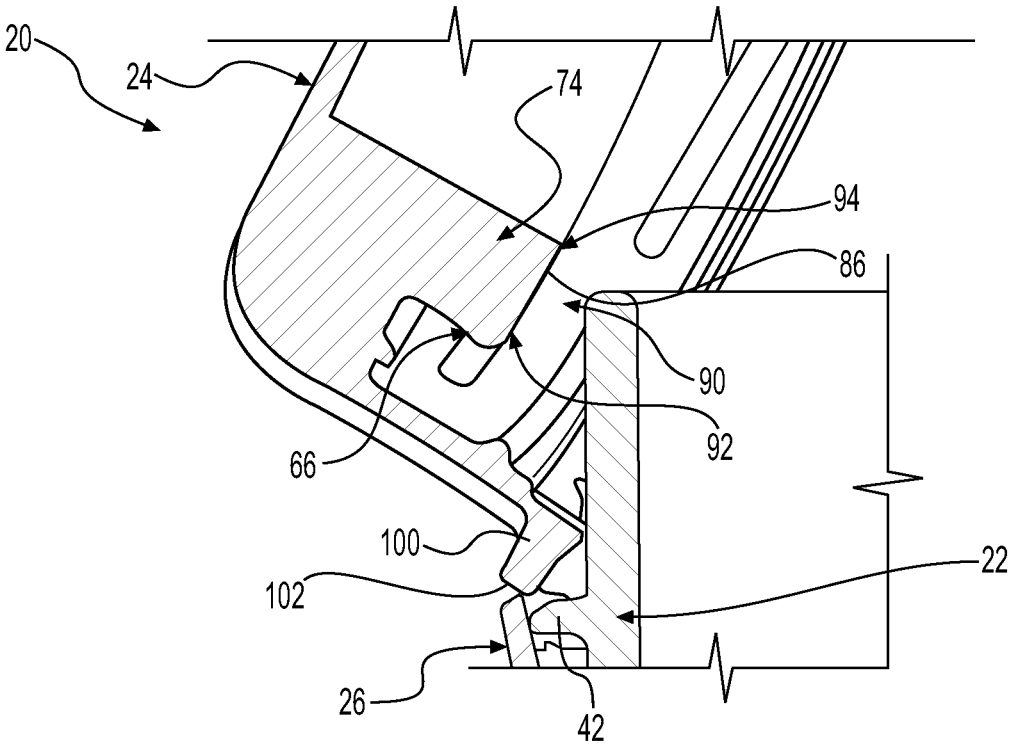
Figure 9:
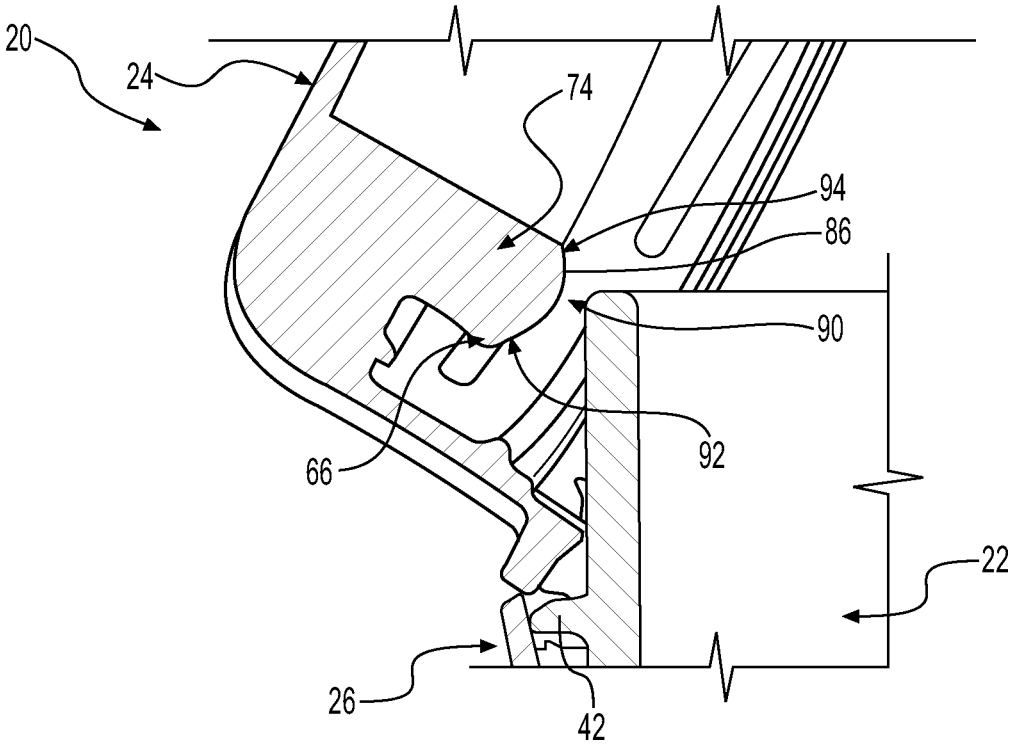
Figure 10:
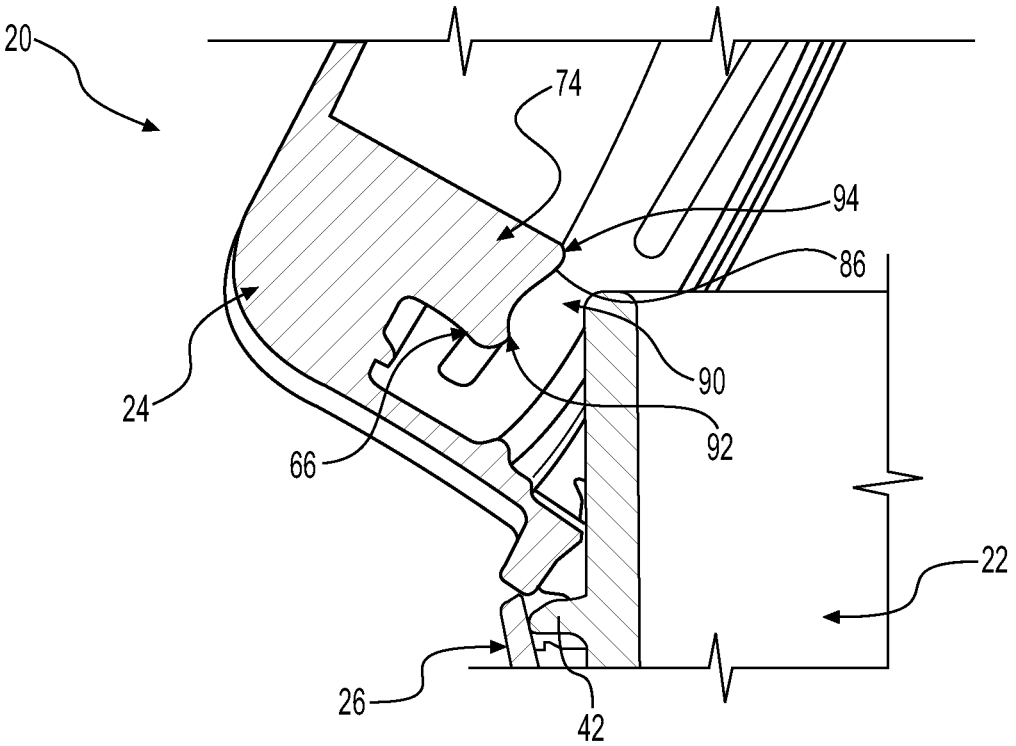

The actuation of the cap 24 between the open configuration to the closed configuration is generally referred to herein as an action of "closing" or "reclosing" the closure device 20. The actuation of the cap 24 from the closed configuration to the open configuration, is generally referred to herein as an action of "opening" the closure device 20. During closing, a number of different closing positions are possible, as best illustrated in FIGS. 8-10. Similarly, during opening, a number of different opening positions are possible (not shown).

Figures 5A, 5B, 5C:
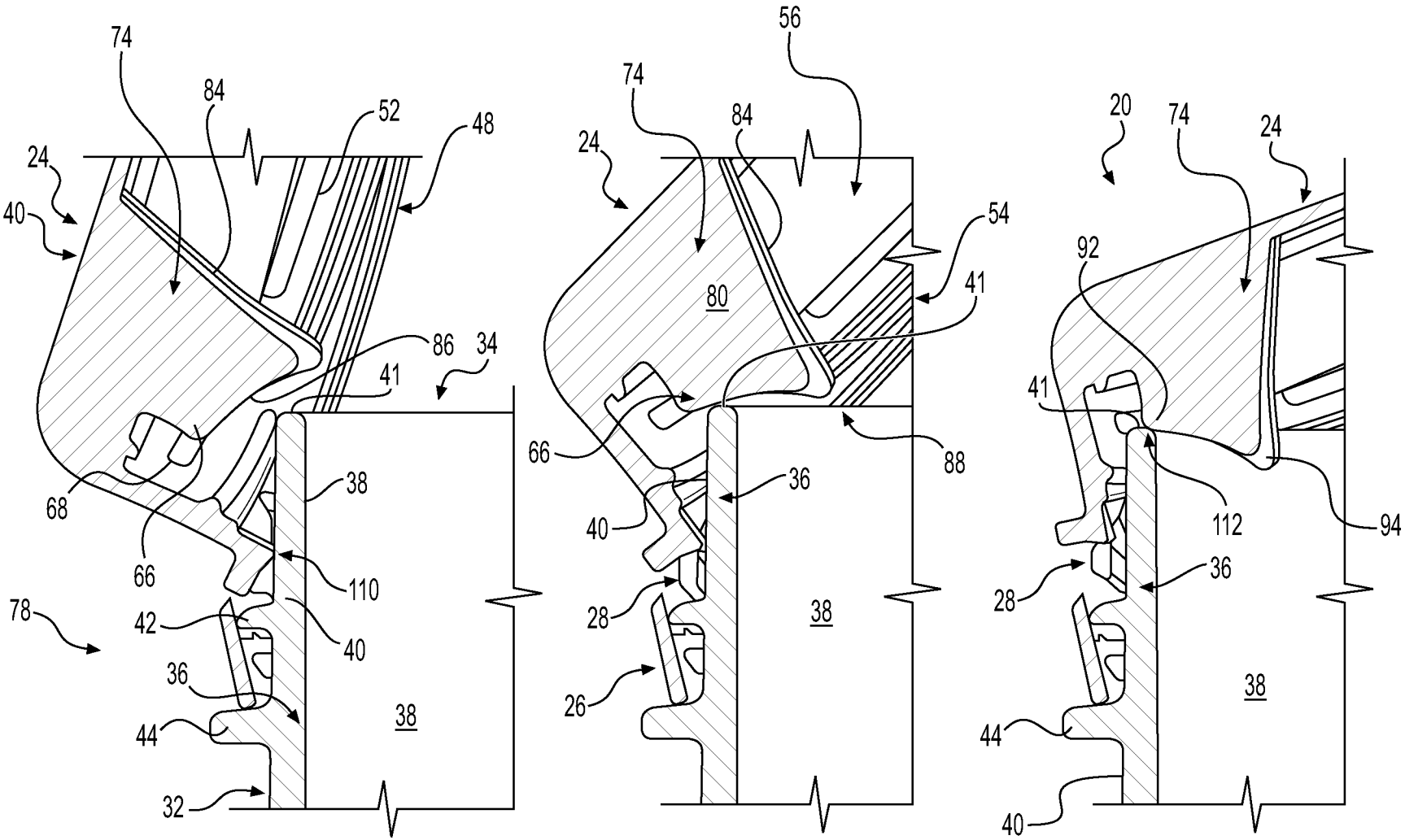
FIGS. 5A-5C are sectional views of the closure device of FIG. 2 during closing on a container, in accordance with some embodiments of the present technology.

As best seen in FIGS. 5A-5C, the cap 24 and the TE band 26 are sized and shaped to be received around a neck 32 of the container 22, the neck 32 defining an open end 34 of the container 22, and the cap 24 being arranged to close and to fluidly seal the open end 34 when in the closed configuration. The neck 32 comprises a container wall 36 having an inner side 38, an outer side 40, and a top end 41.

The container 22 also includes an annular flange 42 (also referred to as a "tamper-evident bead") extending around the outer side of the neck 32 and spaced from the open end 34 of the container 22. The TE band 26 of the closure device 20 is arranged to engage with the tamper evident bead 42 of the container 22, to retain the TE band 26 on the container 22, in use.

The container 22 also has a support ledge 44 extending around the outer side 40 of the neck 32 and spaced from the tamper evident bead 42. The support ledge 44 is spaced further from the open end 34 of the container 22 than the tamper evident bead 42. The support ledge 44 protrudes further from the outer side 40 of the neck 32 of the container 2 than the support ledge 44. A diameter of the TE band 26 of the closure device 20 is less than a diameter of the support ledge 44, which serves to retain the closure device 10 above the support ledge 44 at the neck 32 of the container 22. In other words, a movement of the TE band 26 away from the open end 34 of the container 22 is delimited by the support ledge 44, in use.

Turning now to the cap 24, which is generally cylindrical in shape and has a closed first end 46 and an open second end 48. The cap 24 is arranged to be received over the open end 34 of the container 22. In this respect, at least the second end 48 of the cap 24 has a diameter wider than a diameter of the container 22 at the open end 34, to allow retention of the cap 24 on the neck 32.

In certain embodiments, the closure device 20 is arranged to be retained in the closed configuration by means of a threaded interface with the neck 32 of the container 22. An inner face 50 of the cap 24 has threads 52 which are arranged to cooperate with threads (not shown) on the outer side 40 of the neck 32 of the container 22. The inner face 50 of the cap 24 has a threaded annular portion 54 including the threads 52, and a non-threaded annular portion 56. The threaded annular portion 54 is proximate the open second end 48 of the cap 24 and the non-threaded annular portion 56 is proximate the closed first end 46 of the cap 24.

In alternative embodiments (not shown), one or both of the cap 24 and the neck 32 does not include the threads 52 and is sized and shaped to snap-fit onto the neck 32 to close the open end 34 of the container 22.

An outer face 58 of the cap 24 is textured to facilitate gripping. As seen in FIG. 2, the texturing comprises a plurality of knurls 60 extending in a direction between the first and second ends 46, 48 of the cap 24. It should be noted that the sizing and the pattern of the plurality of knurls 60 is not limited to those depicted herein. It is also noted that in alternative embodiments of the present technology, the plurality of knurls 60 can be omitted altogether.

The cap 24 has a base 62, and an outer wall 64 depending downwardly from the base 62 and extending circumferentially around the base 62. A plug seal 66 is provided in the form of an inner wall depending downwardly from the base 62, and radially spaced from the outer wall 64. The plug seal 66 is illustrated as annular and circumferentially complete, although in other embodiments (not shown), the plug seal 66 may comprise a segmented inner wall.

The plug seal 66 and the outer wall 64 define a channel 68 for sealingly receiving the container wall 36 at the open end 34 of the container 22, in the closed configuration. The plug seal 66 has a rib 70 protruding into the channel 68 and extending around an inner wall 72 of the plug seal 66. The rib 70 contacts the inner side 38 of the container wall 36 when the container wall 36 is received in the channel 68 in the closed configuration of the closure device 20.

A lifting member 74 is provided which depends downwardly from the base 62 and extends radially inwardly from the plug seal 66. As best seen in FIG. 4, the lifting member 74 stops short of a central point 76 in the cap 24. The lifting member 74 is positioned at a pivot side 78 of the cap 24, the pivot side 78 including one or more pivot points of a rotation of the cap 24 during opening and/or closing.

The lifting member 74 comprises a first side wall 80, a second side wall 82, an end wall 84 connecting the first and second side walls 80, 82, and a contact face 86 at a free end 88 of the lifting member 74. The contact face 86 faces the open second end 48 of the cap 24. A profile 90 of the contact face 86 is best seen in FIG. 3. The contact face 86 has a first end 92 proximate the plug seal 66 and a second end 94 proximate the end wall 84 of the lifting member 74. The second end 94 is rounded. In the embodiment of FIG. 3, the profile 90 is angled with respect to the base 62, with the second end 94 of the contact face 86 extending further from the base 62 than the first end 92 of the contact face 86. The profile 90 of the contact face 86 is concavely cambered. A length 96 of the contact face 86 is longer than a thickness 98 of the plug seal 66.

Figure 6:
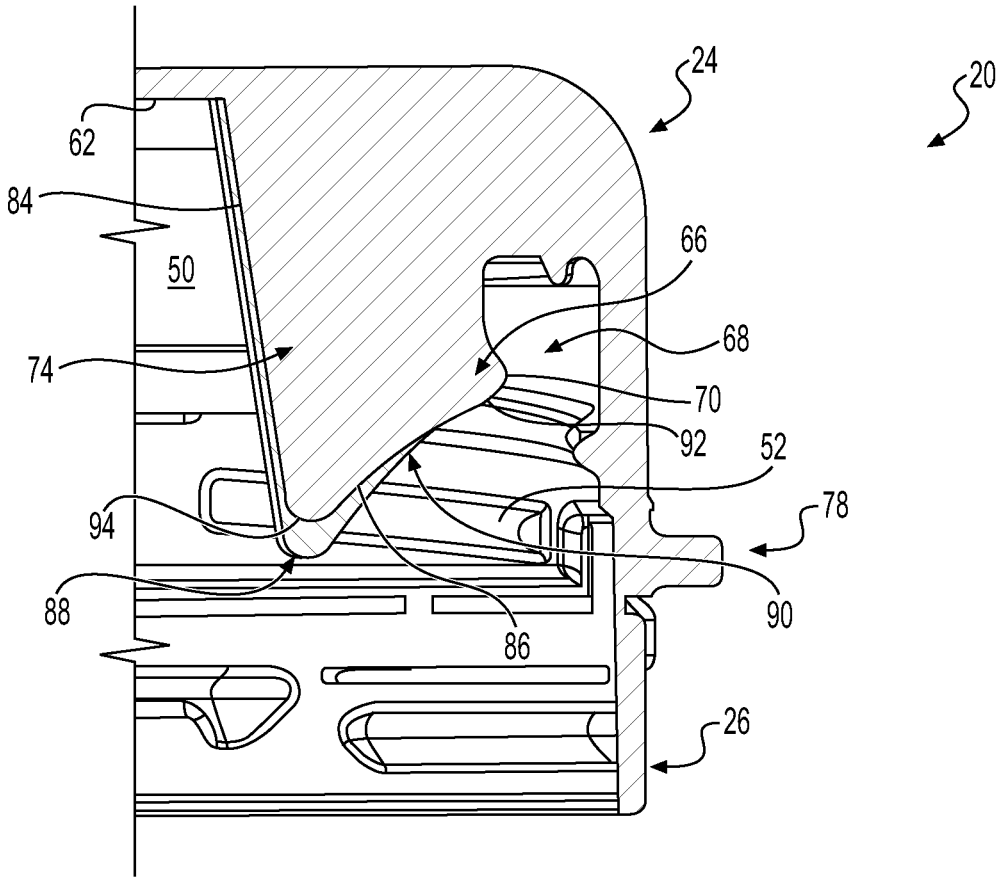
FIG. 6 is a sectional view of another embodiment of the closure device, in accordance with some other embodiments of the present technology.

As can be seen in FIG. 6, the distance of the second end 94 from the base 62 can be adapted to accommodate for containers 22 with different neck 32 diameters. In other embodiments, other dimensions of the lifting member 74 and the contact face 86 are possible. Furthermore, the profile 90 of the lifting member 74 is not limited to that illustrated in FIG. 3 and can take any other suitable form.

Figure 7:
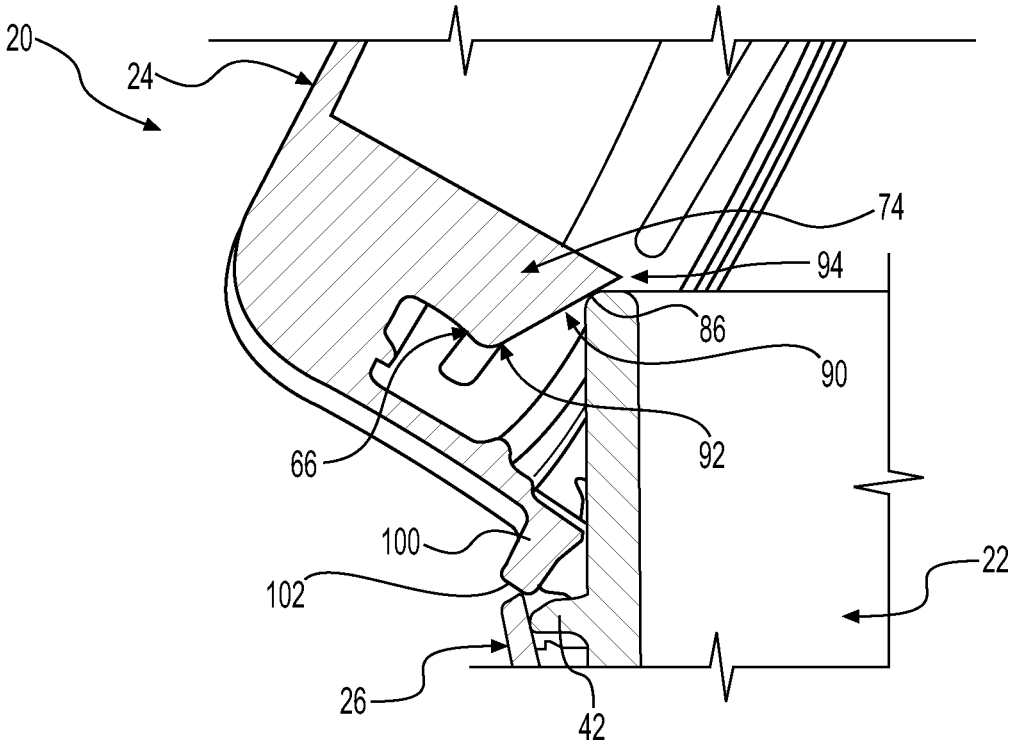
FIGS. 7-10 are sectional views of other embodiments of the closure device of FIG. 2 during closing on a container, in accordance with some embodiments of the present technology.

In the embodiment of FIG. 7, the profile 90 of the lifting member 74 differs from that of FIG. 3 in that it is straight and not cambered.

In the embodiment of FIG. 8, the profile 90 differs from that of FIG. 7 in that the contact face 86 is parallel to the base 62. In other words, the first end 92 and the second end 94 extend by substantially the same distance from the base 62. The profile 90 is straight and not cambered.

In the embodiment of FIG. 9, the profile 90 differs from that of FIG. 8 in that the profile is cambered (convex). A concave camber is also possible.

In the embodiment of FIG. 10, the profile 90 differs from that of FIG. 8 in that the profile is not straight but has an undulation.

As will be appreciated, other configurations of profiles 90 not described or illustrated herein are possible.

It was mentioned earlier that the lifting member 74 is positioned at the pivot side 78 of the closure device 20. By pivot side 78 is meant a side of the closure device 20 which includes at least one pivot point of rotation of the cap 24 during opening or closing. In this respect, the closure device 20 may also comprise at least one hinge (not shown) defining at least one pivot point. Alternatively, the closure device 20 may comprise at least one tongue 100 defining at least one pivot point (FIG. 5).

The closure device 20 may also be provided with a retaining mechanism for retaining the cap 24 in the open configuration. In certain embodiments, the retaining mechanism may include the tongue 100 and a lip 102, extending from the tongue 100, for interaction with the TE band 26 when the cap 24 is in the open configuration (not shown).

Figure 11:
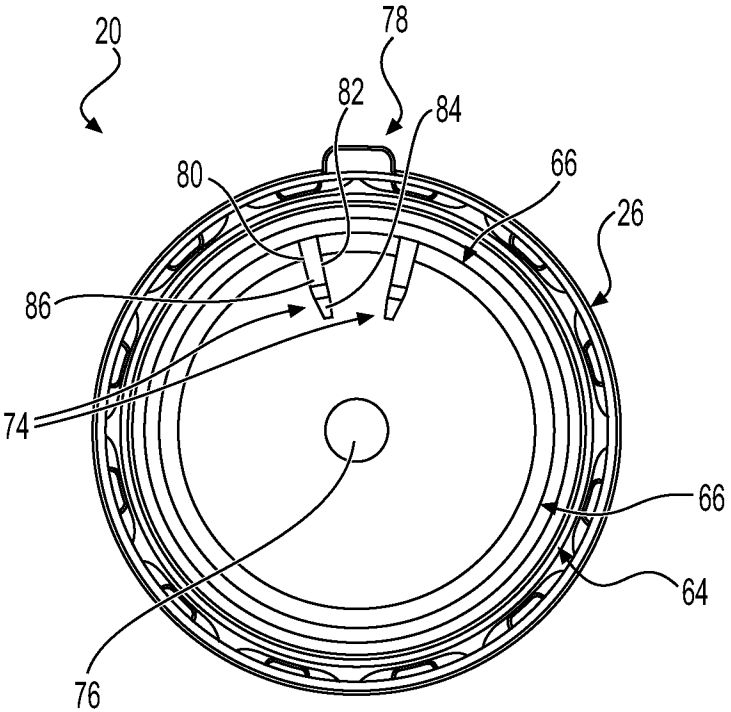

The closure device 20 of FIG. 11 differs from that of FIGS. 2-5 in that two lifting members 74 are provided on the cap 24, radially inwardly of the lip 102 and circumferentially spaced outwardly of the lip 102.

Figure 12:
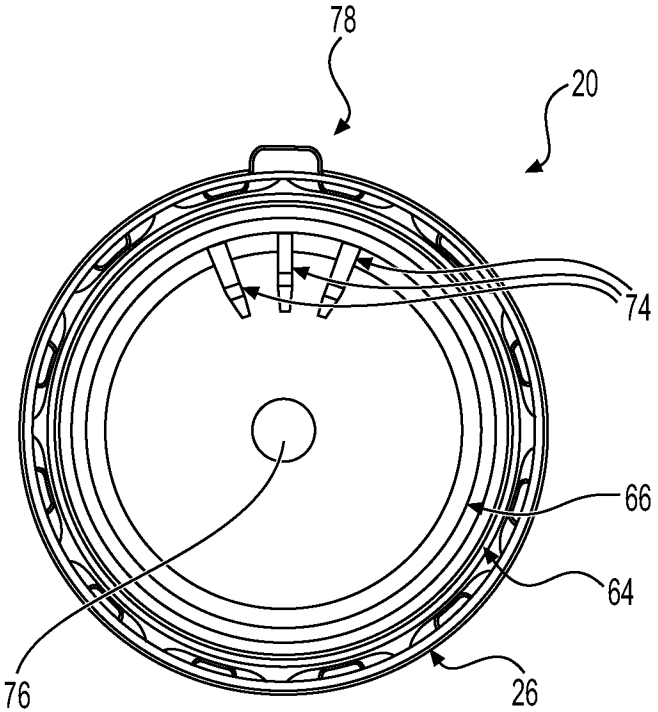
FIGS. 11 and 12 are plan views, respectively, of other embodiments of the closure device of FIG. 2, in accordance with some embodiments of the present technology.

The closure device 20 of FIG. 12 differs from that of FIG. 11 in that an additional lifting member 74 is provided on the cap 24, between the two lifting members 74.

Turning now to the connection of the lifting member 74 with the plug seal 66. In the embodiment of FIGS. 2-5, the lifting member 74 and the plug seal have a one piece construction, formed such as by injection molding or the like. This can be considered as a full connection between the plug seal 66 and the lifting member 74.

Figure 13:
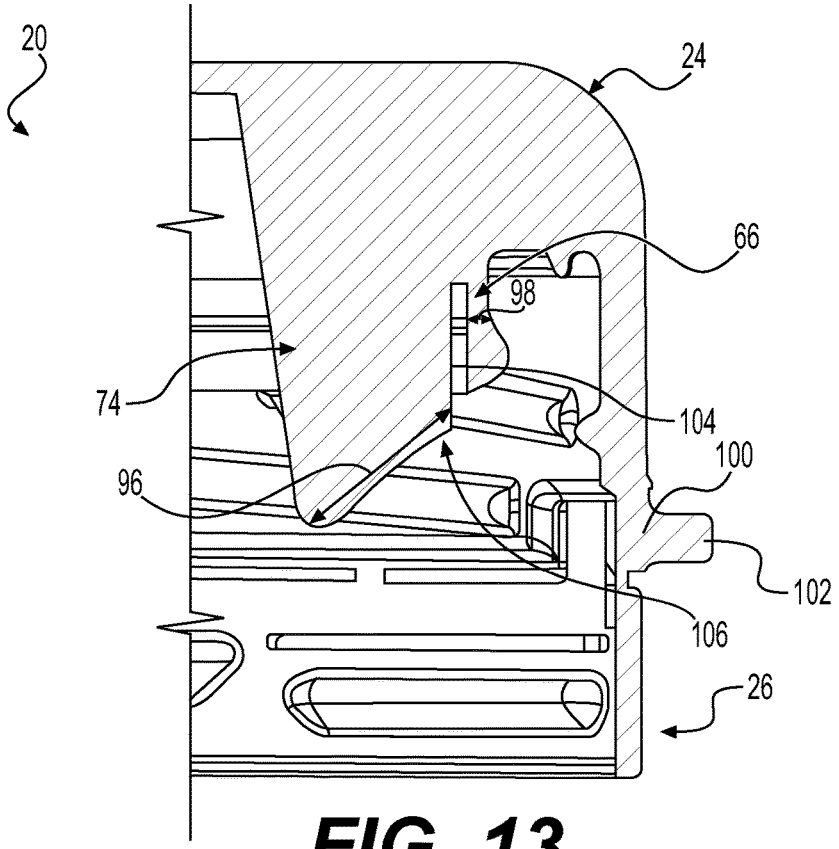
FIG. 13 is a sectional view of another embodiment of the closure device of FIG. 2, in accordance with some embodiments of the present technology.

In certain other embodiments, a separation 104 is provided between a portion of the plug seal 66 and a portion of the lifting member 74 (FIG. 13). In other words, the plug seal 66 and the lifting member 74 are spaced from one another. The separation 104 is at a free end portion 106 of the lifting member 74 and the plug seal 66. As can be seen in FIG. 13, the first end 92 of the contact face 86 of the lifting member 74 extends further from the base 62 than an extension of the plug seal 66 from the base 62. In certain embodiments, this can minimize or avoid the container wall 36 getting stuck in the separation. The separation 104 is also provided in certain pressurized container applications as it can avoid or reduce leakage of the container. In embodiments of the closure device 20 which include the separation 104, the closure device 20 can include, in certain embodiments, any of the prior illustrated and described profiles and other features such as lifting members 74 whether alone or in any combination with one another.

Figure 1A:
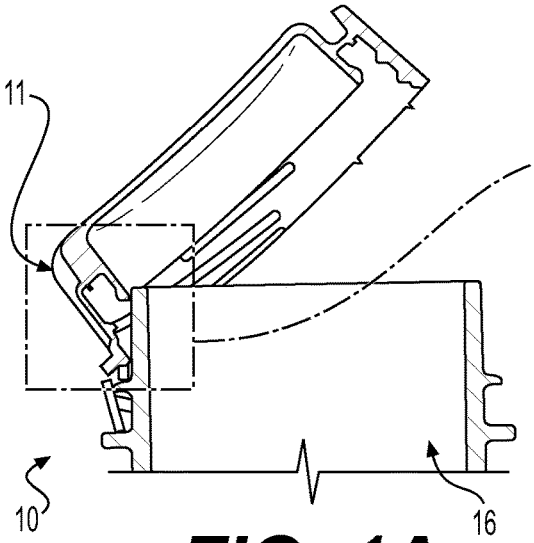
FIG. 1A (PRIOR ART)
FIG. 1A is a sectional view of a prior art closure device during re-closing on a container.
Figure 1B:
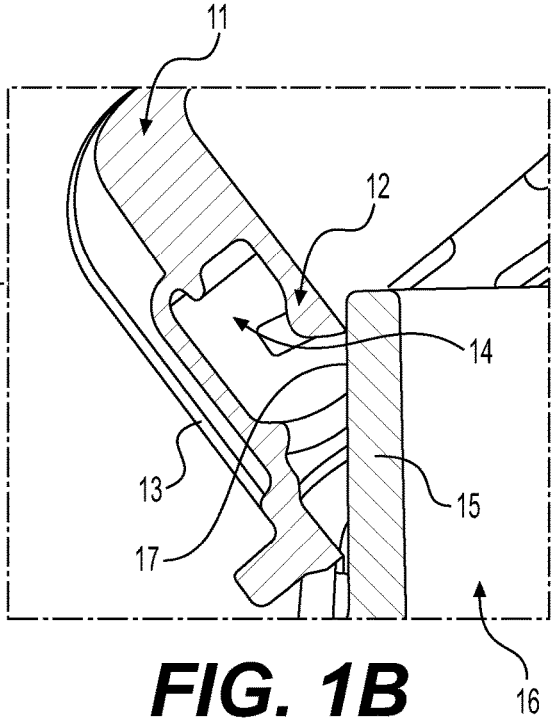
FIG. 1B (PRIOR ART)
FIG. 1B is a close-up of a plug seal region of the prior art closure device of FIG. 1A.
Figure 14:
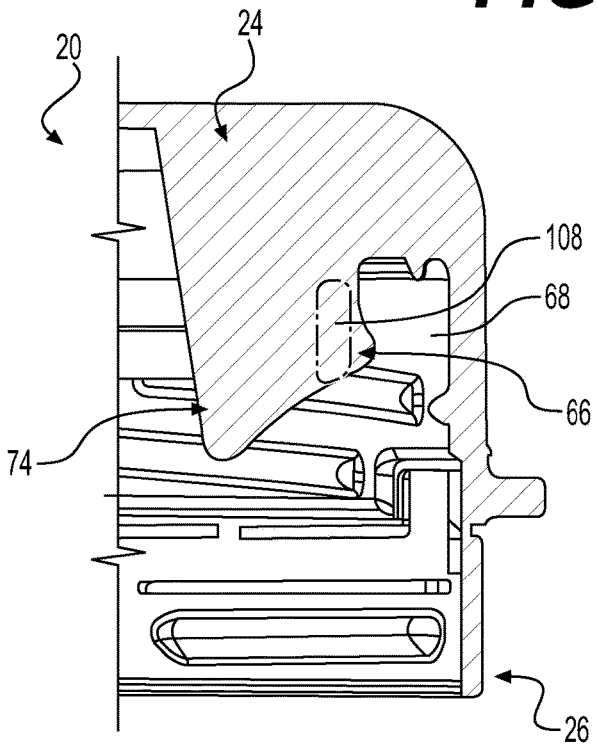
FIG. 14 is a sectional view of yet another embodiment of the closure device of FIG. 2, in accordance with some embodiments of the present technology.
Figure 15:
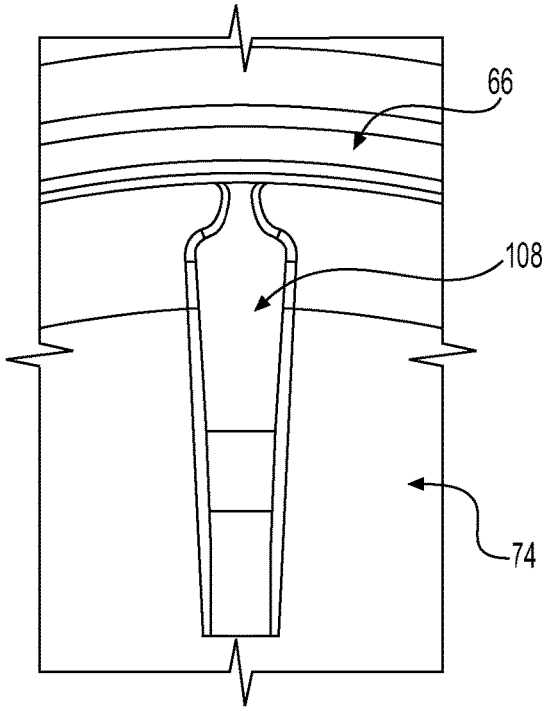
FIG. 15 is a close-up of a lifting member of the closure device of FIG. 14, in accordance with some embodiments of the present technology.

In the embodiment of FIGS. 14 and 15, the lifting member 74 is connected to the plug seal 66 by a thinned portion 108. The thinned portion 108 is between the first side wall 80 and the second side wall 82 of the lifting member 74. In certain embodiments, providing such a thinned portion 108 between the lifting member 74 and the plug seal 66 can minimize or avoid deformation of the plug seal 66 during the manufacture of the closure device 20 by molding due to shrinkage of the lifting member 74. A functioning of the closure device 20 during closing will now be described with reference to FIGS. 5A to 5C. Actuating the cap 24 from the open configuration towards the closed configuration comprises a rotation of the cap 24 relative to the neck 32 about a starting pivot point 110 (FIG. 5A). Continued rotation of the cap 24 about the starting pivot point 110 causes the contact face 86 to come into contact with the top end 41 of the container 22 (FIG. 5B). Continuing the rotation of the cap 24 causes the lifting of the cap 24 upwardly away from the TE band 26 (FIG. 5C). Continued rotation about a lifted pivot point 112 causes the contact face 86 to guide the movement of the cap 24 such that the top end 41 of the container slides towards the first end 92 of the contact face 86 and is guided into the channel 68. As can be seen best in FIG. 5C when compared to the prior art situation of FIG. 1, a vertical axis of the container wall 36 is close to being substantially aligned with a vertical axis of the channel 68 at the point of entry of the container wall 36 into the channel 68, thereby minimizing or avoiding damage to the plug seal 66.

As such, it can be said that the lifting member 74 functions to lift the cap 24 upwardly away from the TE band 26, to move a pivot point upwardly also, and to guide movement of the cap 24 such that the container wall 36 is received in the channel 68.

In certain embodiments, the closure device 20 is made by injection molding using a mold adapted to form the closure device 20 from a melt which is the molding material. The mold is positionable, in use, within an injection molding machine, an example of which will be described later. Briefly, during the injection molding process, the melt is injected into the mold and then cooled to form a solid molded article. The molding material may be, for example, high density polyethylene (HDPE) or polypropylene (PP).

In such embodiments where the closure device 20 is made by injection molding, the cap 24 may be provided with a protruding member 120. The presence of the associated feature in the mold for making the protruding member 120 can cause a more symmetric flow of the melt into the mold when making the closure device 20. This can help to prolong a lifetime of the mold and prevent or delay wearing of the mold. It is to be noted that, in certain embodiments, the protruding member 120 does not serve a function relating to the opening or closing of the cap. In certain embodiments, the protruding member 120 is positioned and configured to provide a balanced melt flow during injection molding. The protruding member 120 has one or more of a volumetric symmetry, a positional symmetry and a lit configuration symmetry to the lifting member 74.

Figure 16:
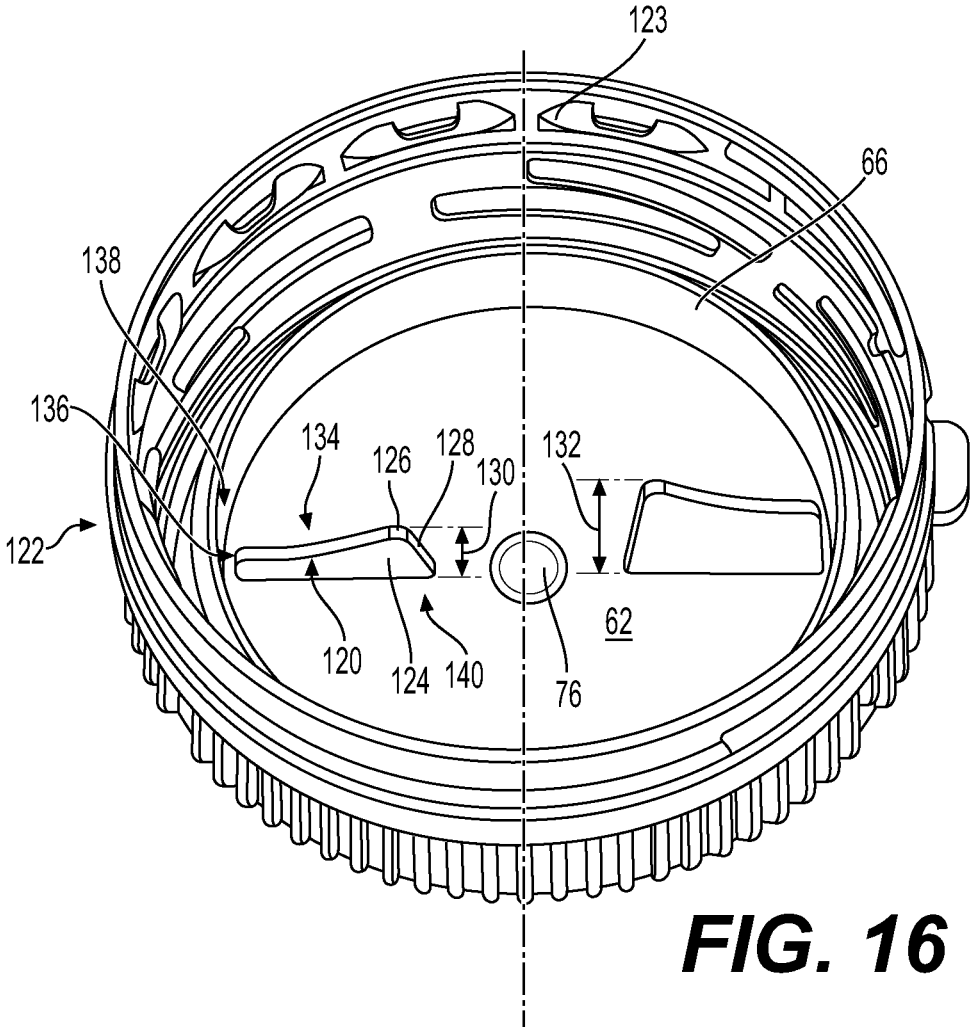
FIG. 16 is a perspective view of a closure device including a protruding member in accordance with some other embodiments of the present technology.

As best seen in FIG. 16, the protruding member 120 extends from the base 62 and is positioned radially inwardly from the plug seal 66. The protruding member 120 is positioned on a side 122 of the cap 24 which is opposite to the pivot side 78 and a position of the lifting member 74. A position of the protruding member 120 is symmetrical to a position of the lifting member 74. In this respect, the position of the lifting member 74 mirrors the position of the lifting member 74 about a plane 123 extending through the central point 76 of the cap. In certain other embodiments, the position of the protruding member 120 is not symmetrical to a position of the lifting member 74. In certain non-limiting embodiments, an elongate axis of the protruding member 120 lies on substantially the same plane as an elongate axis of the lifting member 74.

The lifting member 74 and the protruding member 120 are separate from one another. In this respect, the protruding member 120 stops short of the central point 76 in the cap 24. However, in certain other embodiments, the lifting member 74 and the protruding member 120 are one-piece and extend across the central point 76.

The protruding member 120 comprises a first side wall 124, a second side wall 126, and an end wall 128 connecting the first and second side walls 124, 126. The first and second side walls 124, 126 are parallel to one another. The protruding member 120 has a blade-like appearance.

In certain embodiments, a configuration of the protruding member 120 is a mirror image of a configuration of the lifting member 74. By configuration is meant one or more of a height, a length, a width, a volume. However, it will be appreciated that the configurations of the protruding member 120 and the lifting member 74 may be different whilst still providing a balanced melt flow during injection molding.

One non-limiting example of a configuration of the protruding member 120 which deviates from being a mirror image of the configuration of the lifting member, whilst still providing balanced melt flow during manufacture, is shown in FIG. 16. In the illustrated embodiment, a height 130 of the protruding member 120 is less than a height 132 of the lifting member 74. The height 130 of the protruding member 120 may be between about 50% and about 100% of the height 132 of the lifting member 74. In certain other embodiments, the height 130 of the protruding member 120 is the same as the height 132 of the lifting member 74.

As can be seen in FIG. 16, the height 130 from the base 62 is not necessarily the same along a length of the protruding member 120. In the embodiment of FIG. 16, a distal end 138 of the protruding member 120 extends further from the base 62 than a proximal end 140 of the protruding member 120. Therefore, by "height" is meant a maximum transverse distance from the base 62.

Generally, the closer the configurations of the protruding member 120 and the lifting member 74 to one another, the more balanced is the melt flow into the mold, with the melt flow being best balanced when the configurations of the protruding member 120 and the lifting member 74 are the same.

Turning now to the connection of the protruding member 74 with the plug seal 66, in the embodiment of FIG. 16, a separation 136 is provided between a portion of the plug seal 66 and a portion of the protruding member 120. In other words, the plug seal 66 and the protruding member 120 are spaced from one another. The separation 136 is at the distal end 138 of the protruding member 120.

In other embodiments (not shown), the protruding member 120 and the plug seal have a one-piece construction, formed such as by injection molding or the like. This can be considered as a full connection between the plug seal 66 and the protruding member 120.

In yet other embodiments (not shown), the protruding member 120 is connected to the plug seal 66 by a thinned portion. The thinned portion is between the first side wall 124 and the second side wall 126 of the protruding member 120.

Figure 17:
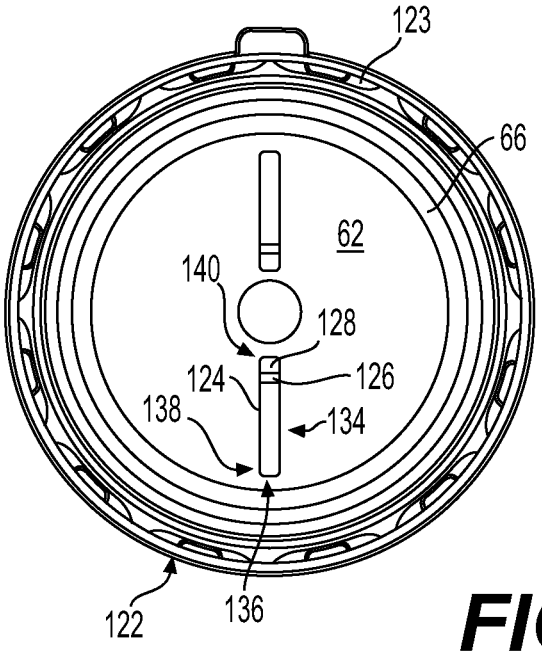
FIG. 17 is a schematic depiction of an injection molding system that can be adapted to implement non-limiting embodiments of the present technology.

The embodiment of FIGS. 16 and 17 illustrates a closure device 10 with a single protruding member 120 extending from the cap 24. However, in other embodiments which are not shown, there may be provided, more than one protruding member 120, such as two, three or four protruding members 120. In these embodiments, the plurality of protruding members 120 are circumferentially spaced from one other. In embodiments with the plurality of protruding members 120, there may also be provided a plurality of lifting members 74. A number of protruding members 120 may match a number of lifting members extending from the base 62 of the cap 24.

A mold assembly for making the closure device 10, for use in an injection molding machine, comprises a molding cavity, defined, at least in part, by a female cavity piece and a male core piece, mounted respectively on a cavity plate and a core plate of a mold. The molding cavity is arranged to receive heated molding material ("the melt") for making the closure device injected under pressure in a molten state. The melt may be supplied from an injection unit of an injection molding machine through one or more associated nozzles. The melt may be derived from a solid form of the molding material, such as but not limited to pellets, powder or flakes, or any other form known in the art. The molding material may comprise HDPE or PP, as an example.

The cavity plate and the core plate are urged together and are held together by clamp force, the clamp force being sufficient enough to keep the cavity and the core pieces together against the pressure of the injected molding material. The molding cavity has a shape that substantially corresponds to a final cold-state shape of the closure device 10. The so-injected molding material is then cooled to a temperature sufficient to enable ejection of the so-formed closure device from the mold. When cooled, the molded closure device shrinks inside of the molding cavity and, as such, when the cavity and core plates are urged apart, the molded article can be demolded, i.e. ejected off of the core piece. Ejection structures are known to assist in removing the molded articles from the core halves. Examples of the ejection structures include stripper plates, ejector pins, etc.

Figure 18:
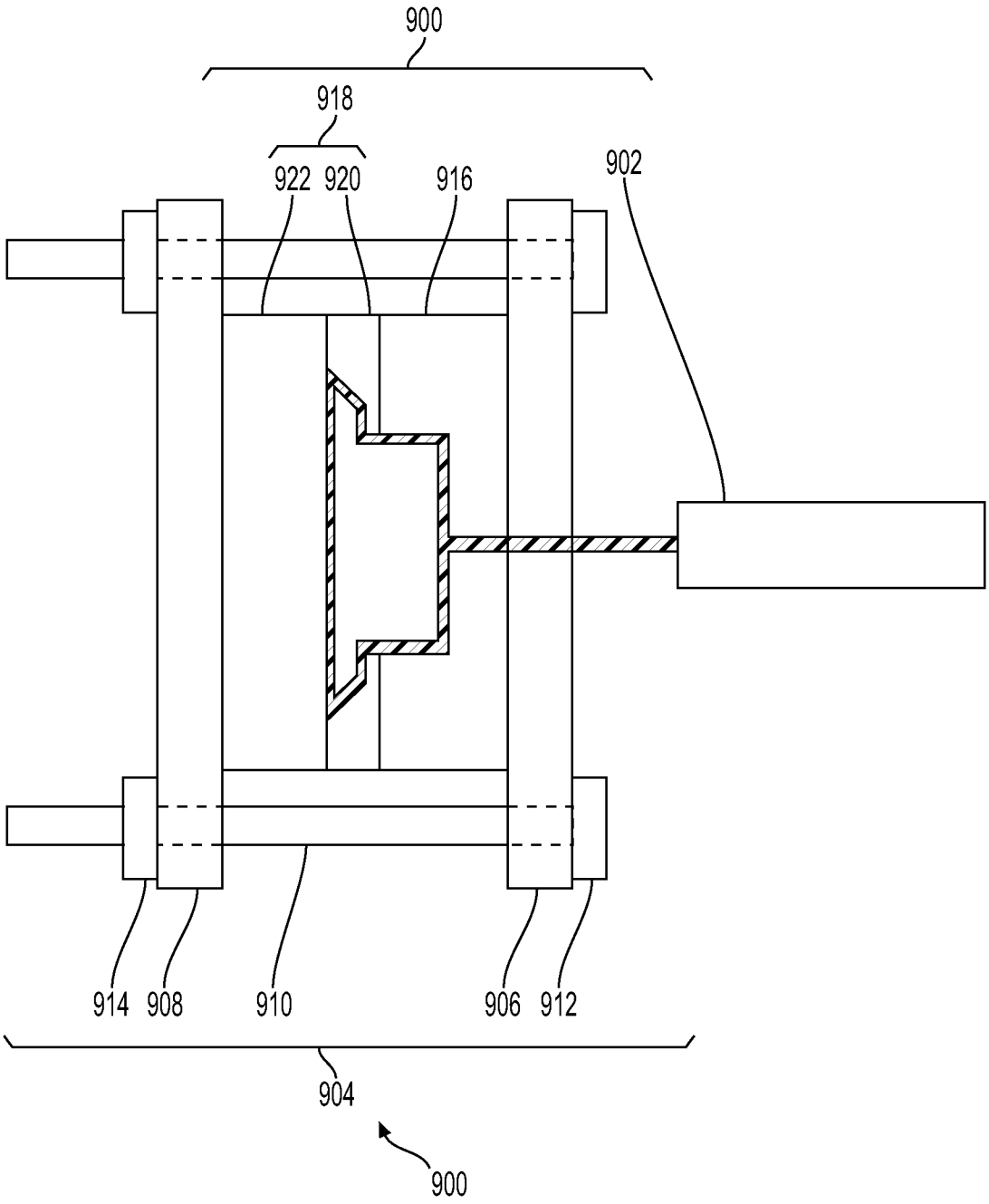
FIG. 18 is a schematic depiction of an injection molding system.

FIG. 18 depicts an example embodiment of an injection molding machine 900 for forming the cap 24 from molding material using the mold assembly. Injection molding machines are well known in the art and, as such, will not be described here at any length. A detailed description of these known injection molding machines may be referenced, at least in part, in the following reference books (for example): (i) "Injection Molding Handbook" authored by OSSWALD/TURNG/GRAMANN (ISBN: 3-446-21669-2), (ii) "Injection Molding Handbook" authored by ROSATO AND ROSATO (ISBN: 0-412-10581-3), (iii) "Injection Molding Systems" 3rd Edition authored by JOHANNABER (ISBN 3-446-17733-7); (iv) "Runner and Gating Design Handbook" authored by BEAUMONT (ISBN 1-446-22672-9); WO 2010/144993 and/or (v) US 2015/0037448 A1, aspects of which may be incorporated herein. For example, aspects of the injection molding system 900 depicted in FIG. 18 are described in US 2015/0037448 A1.

According to the example of FIG. 18, the injection molding system 900 includes (and is not limited to) an extruder assembly, a clamp assembly, a runner system, and/or a mold assembly 918. By way of example, the extruder assembly 902 is configured to prepare, in use, the heated, flowable melt, and is also configured to inject or to move the melt from the extruder assembly 902 toward the runner system 916. Other names for the extruder assembly 902 may include "injection unit," "melt-preparation assembly," etc. By way of example, the clamp assembly 904 includes (and is not limited to): a stationary platen 906, a movable platen 908, a rod assembly 910, a clamping assembly 912, and/or a lock assembly 914. The stationary platen 906 does not move; that is, the stationary platen 906 may be fixedly positioned relative to the ground or floor. The movable platen 908 is configured to be movable relative to the stationary platen 906. A platen-moving mechanism (not depicted but known) is connected to the movable platen 908, and the platen-moving mechanism is configured to move, in use, the movable platen 908. The rod assembly 910 extends between the movable platen 908 and the stationary platen 906. The rod assembly 910 may have, by way of example, four rod structures positioned at the corners of the respective stationary platen 906 and the movable platen 908. The rod assembly 910 is configured to link the movable platen 908 to the stationary platen 906. A clamping assembly 912 is connected to the rod assembly 910. The stationary platen 906 is configured to support (or configured to position) the position of the clamping assembly 912. The lock assembly 914 is connected to the rod assembly 910, or may alternatively be connected to the movable platen 908. The lock assembly 914 is configured to selectively lock and unlock the rod assembly 910 relative to the movable platen 908. By way of example, the runner system 916 is attached to, or is supported by, the stationary platen 906. The runner system 916 is configured to receive the resin from the extruder assembly 902.

By way of example, the mold assembly 918 includes (and is not limited to): a mold-cavity assembly 920 and a mold-core assembly 922 that is movable relative to the mold-cavity assembly 920. The mold-core assembly 922 is attached to or supported by the movable platen 908. The mold-cavity assembly 920 is attached to or supported by the runner system 916, so that the mold-core assembly 922 faces the mold-cavity assembly 920. The runner system 916 is configured to distribute the melt from the extruder assembly 902 to the mold assembly 918.

In operation, the movable platen 908 is moved toward the stationary platen 906 so that the mold-cavity assembly 920 is closed against the mold-core assembly 922, so that the mold assembly 918 may define a mold cavity configured to receive the melt from the runner system 916. The lock assembly 914 is engaged so as to lock the position of the movable platen 908 so that the movable platen 908 no longer moves relative to the stationary platen 906. The clamping assembly 912 is then engaged to apply a clamping pressure, in use, to the rod assembly 910, so that the clamping pressure then may be transferred to the mold assembly 918. The extruder assembly 902 pushes or injects, in use, the melt to the runner system 916, which then the runner system 916 distributes the melt to the mold cavity structure defined by the mold assembly 918. Once the melt in the mold assembly 918 is solidified, the clamping assembly 912 is deactivated so as to remove the clamping force from the mold assembly 918, and then the lock assembly 914 is deactivated to permit movement of the movable platen 908 away from the stationary platen 906, and then a molded article may be removed from the mold assembly 918.

It will be appreciated that the injection molding system 900 may include more than two platens. According to an example, the injection molding system 900 includes (and is not limited to) a third platen (not depicted), which is also called a "clamping platen" that is known in the art and thus is not described here in greater detail.

It should be expressly understood that various technical effects mentioned throughout the description above need not be enjoyed in each and every embodiment of the present technology. As such, it is anticipated that in some implementations of the present technology, only some of the above-described technical effects may be enjoyed. While in other implementations of the present technology, none of the above enumerated technical effects may be present, while other technical effects not specifically enumerated above may be enjoyed. It should be expressly understood that the above enumerated technical effects are provided for illustration purposes only, to enable those skilled in the art to better appreciate embodiments of the present technology and by no means are provided to limit the scope of the present technology or of the claims appended herein below.

It is noted that the foregoing has outlined some of the more pertinent non-limiting embodiments. It will be clear to those skilled in the art that modifications to the disclosed non-embodiment(s) can be effected without departing from the spirit and scope thereof. As such, the described non-limiting embodiment(s) ought to be considered to be merely illustrative of some of the more prominent features and applications. Other beneficial results can be realized by applying the non-limiting embodiments in a different manner or modifying them in ways known to those familiar with the art. This includes the mixing and matching of features, elements and/or functions between various non-limiting embodiment(s) is expressly contemplated herein so that one of ordinary skill in the art would appreciate from this disclosure that features, elements and/or functions of one embodiment may be incorporated into another embodiment as skill in the art would appreciate from this disclosure that features, elements and/or functions of one embodiment may be incorporated into another embodiment as appropriate, unless described otherwise, above. Although the description is made for particular arrangements and methods, the intent and concept thereof may be suitable and applicable to other arrangements and applications.

What is claimed is:

1. A closure device for a container neck, the closure device having a cap which is pivotable between a closed configuration and an open configuration relative to the container neck, the cap comprising:

a base;

an outer wall extending circumferentially around the base;

a plug seal extending from the base, at an inner face of the cap, and spaced from the outer wall to define a channel or receiving the container neck and for forming a seal against an inner wall of the container neck when the cap is in the closed configuration;

a lifting member extending from the base and positioned radially inwardly from the plug seal, the lifting member being positioned at a pivot-side of the cap and having a contact face at a free end of the lifting member for contacting a top end of the container neck before the top end contacts the plug seal during actuation of the cap from the open configuration to the closed configuration.

2. The closure device of claim 1, wherein the plug seal is annular.

3. The closure device of claim 1, wherein the lifting member and the plug seal have a one-piece construction.

4. The closure device of claim 3, wherein a portion of the one-piece construction is thinned.

5. The closure device of claim 4, wherein the thinned portion extends downwardly from the base and stops short of the free end of the lifting member.

6. The closure device of claim 1, wherein at least a portion of the lifting member is spaced from the plug seal.

7. The closure device of claim 6, wherein a free end portion of the lifting member is spaced from the plug seal.

8. The closure device of claim 1, further comprising a plurality of lifting members extending from the base and positioned radially inwardly from the plug seal, the plurality of lifting members being circumferentially spaced from one another and proximate the pivot-side of the cap.

9. The closure device of claim 8, wherein the plurality of lifting members comprises two lifting members positioned one on either side of a tongue at the pivot-side.

10. The closure device of claim 9, further comprising a third lifting member positioned between the two lifting members.

11. The closure device of claim 1, wherein the contact face has a first end proximate the plug seal and a second end (positioned radially inwardly to the first end, wherein the second end is rounded.

12. The closure device of claim 1, wherein the contact face has a first end proximate the plug seal and a second end positioned radially inwardly to the first end, wherein the second end extends further from the base than the first end.

13. The closure device of claim 12, wherein a profile of the contact face is one of: cambered, straight and undulating.

14. The closure device of claim 1, wherein a length of the contact face is substantially longer than a thickness of the plug seal.

15. The closure device of claim 1, wherein the pivot side of the closure device comprises a pivot point defined by one or more of: a hinge, a leash, a tongue, and a lip.

16. The closure device of claim 1, further comprising a TE band and at least one leash connecting the cap to the TE band.

17. The closure device of claim 1, further comprising a retention mechanism for retaining the cap in the open configuration.

18. The closure device of claim 1, further comprising a protruding member extending from the base and positioned radially inwardly from the plug seal, the protruding member having one or more of a volumetric symmetry, a positional symmetry and a configuration symmetry to the lifting member.

19. The closure device of claim 18, wherein the position of the protruding member mirrors the position of the lifting member about a plane extending through the central point of the cap.

20. The closure device of claim 19, wherein an elongate axis of the protruding member lies on substantially the same plane as an elongate axis of the lifting member.

21. A mold for forming a closure device by injection molding, the mold comprising a female cavity piece and a male core piece, the female cavity piece and the male core piece defining a molding cavity configured to form the closure device of claim 1.

22. The closure device of claim 1, wherein the contact face has a first end proximate the plug seal and a second end positioned radially inwardly to the first end, wherein the first and second ends extend by substantially the same distance from the base.

23. A closure device for a container neck, the closure device having a cap which is actuatable between a closed configuration and an open configuration relative to the container neck, the cap comprising:

a base;

an outer wall extending circumferentially around the base;

a plug seal extending from the base, at an inner face of the cap, and spaced from the outer wall to define a channel for receiving the container neck and for forming a seal against an inner wall of the container neck when the cap is in the closed configuration;

a lifting member extending from the base and positioned radially inwardly from the plug seal, the lifting member having a contact face at a free end of the lifting member for contacting a top end of the container neck during actuation of the cap from the open configuration to the closed configuration, wherein the lifting member is partially connected to the plug seal.

24. The closure device of claim 23, wherein the thinned portion extends downwardly from the base and stops short of the free end of the lifting member.

25. The closure device of claim 23, wherein the lifting member is positioned at a pivot-side of the closure device and is adapted such that the contact face contacts a top end of the container neck before the top end contacts the plug seal during actuation of the cap from the open configuration to the closed configuration.

26. The closure device of claim 25, wherein the pivot side of the closure device comprises a pivot point defined by one or more of: a hinge, a leash, a tongue, and a lip.

27. The closure device claim 23, wherein the plug seal is annular.

28. The closure device of claim 27, wherein the contact face has a first end proximate the plug seal and a second end positioned radially inwardly to the first end, wherein the first and second ends extend by substantially the same distance from the base.

29. The closure device claim 23, further comprising a plurality of lifting members extending from the base and positioned radially inwardly from the plug seal, the plurality of lifting members being circumferentially spaced from one another.

30. The closure device of claim 29, wherein the plurality of lifting members comprises two lifting members, positioned one on either side of a tongue extending from an outer side of the cap.

31. The closure device of claim 30, further comprising a third lifting member positioned between the two lifting members.

32. The closure device of claim 23, wherein the contact face has a first end proximate the plug seal and a second end positioned radially inwardly to the first end wherein the second end is rounded.

33. The closure device of claim 23, wherein the contact face has a first end-proximate the plug seal and a second end positioned radially inwardly to the first end, wherein the second end extends further from the base than the first end.

34. The closure device of claim 33, wherein a profile of the contact face is one of: cambered, straight and undulating.

35. The closure device of claim 23, wherein a length of the contact face is substantially longer than a thickness of the plug seal.

36. The closure device of claim 23, further comprising a TE band and at least one leash connecting the cap to the TE band.

37. The closure device of claim 23, further comprising a retention mechanism for retaining the cap in the open configuration.

38. The closure device of claim 37, wherein a profile of the contact face is one of: cambered, straight and undulating.

39. The closure device of claim 23, further comprising a protruding member extending from the base and positioned radially inwardly from the plug seal, the protruding member having one or more of a volumetric symmetry, a positional symmetry and a configuration symmetry to the lifting member.

40. The closure device of claim 39, wherein the position of the protruding member mirrors the position of the lifting member about a plane extending through the central point of the cap.

41. The closure device of claim 40, wherein an elongate axis of the protruding member lies on substantially the same plane as an elongate axis of the lifting member.

42. A mold for forming a closure device by injection molding, the mold comprising a female cavity piece and a male core piece, the female cavity piece and the male core piece defining a molding cavity configured to form the closure device of claim 23.

43. The closure device of claim 23, wherein the lifting member is connected to the plug seal only at a free end portion thereof.

44. The closure device of claim 23, wherein the lifting member is connected to the plug seal by a thinned portion.

45. A closure device for a container neck, the closure device having a cap which is pivotable between a closed configuration and an open configuration relative to the container neck, the cap comprising:

a base;

outer wall extending circumferentially around the base;

a plug seal extending from the base, at an inner face of the cap, and spaced from the outer wall to define a channel for receiving the container neck and for forming a seal against an inner side wall of the container neck when the cap is in the closed configuration;

a lifting member extending from the base and positioned radially inwardly from the plug seal, the lifting member being positioned at a pivot-side of the cap and having a contact face at a free end of the lifting member for contacting the container neck during actuation of the cap from the open configuration to the closed configuration; and a protruding member extending from the base and positioned radially inwardly from the plug seal, the protruding member being positioned on a side of the cap which is opposite to the pivot-side.

46. The closure device of claim 45, wherein a height of the protruding member from the base is from about 50% to about 100% of a height of the lifting member from the base.

47. The closure device of claim 45, wherein the protruding member and the lifting member lie on the same plane along the base.

48. The closure device of claim 45, wherein the protruding member is spaced from the plug seal.

49. The closure device of claim 45, wherein the protruding member and the lifting member both stop short of a central point in the cap.

50. The closure device of claim 45, wherein there are a plurality of protruding members extending from the base and positioned radially inwardly from the plug seal.

51. The closure device of claim 45, the protruding member having one or more of a volumetric symmetry, a positional symmetry and a configuration symmetry to the lifting member.

52. The closure device of claim 51, wherein the position of the protruding member mirrors the position of the lifting member about a plane extending through the central point of the cap.

53. The closure device of claim 52, wherein an elongate axis of the protruding member lies on substantially the same plane as an elongate axis of the lifting member.

54. A mold for forming a closure device by injection molding, the mold comprising a female cavity piece and a male core piece, the female cavity piece and the male core piece defining a molding cavity configured to form the closure device of claim 45.

* * * * *